US005904193A

United States Patent [19]

Kellner

[11] Patent Number: 5,904,193

[45] Date of Patent: May 18, 1999

[54] CUTTER HEAD, IN PARTICULAR A PLANING CUTTER HEAD

[75] Inventor: Karl-Heinz Kellner, Aalen, Germany

[73] Assignee: Gebr. Leitz GmbH & Co., Oberkochen, Germany

[21] Appl. No.: 08/930,971

[22] PCT Filed: Apr. 11, 1996

[86] PCT No.: PCT/EP96/01539

§ 371 Date: Jan. 14, 1998

§ 102(e) Date: Jan. 14, 1998

[87] PCT Pub. No.: WO96/33056

PCT Pub. Date: Oct. 24, 1996

[30] Foreign Application Priority Data

Apr. 15, 1995 [DE] Germany ..... 295 06 458 U

[51] Int. Cl.[6] ..... B27G 13/00

[52] U.S. Cl. ..... 144/230; 144/218; 144/241; 407/50; 407/49; 407/108

[58] Field of Search ..... 144/162.1, 172–174, 144/176, 218, 229, 230, 221, 241; 407/50, 108, 109, 111, 41, 42, 49

[56] References Cited

U.S. PATENT DOCUMENTS

| | | | |
|---|---|---|---|
| 1,611,298 | 12/1926 | Wilderson . | |
| 3,865,164 | 2/1975 | Sybertz | 144/230 |
| 3,868,751 | 3/1975 | Holthuis | 407/50 |
| 4,068,694 | 1/1978 | Schmidt et al. . | |
| 4,194,545 | 3/1980 | Kostermeier | 144/230 |
| 4,470,442 | 9/1984 | Krautzberger et al. | 407/50 |
| 4,544,009 | 10/1985 | Krocher | 144/230 |
| 4,850,406 | 7/1989 | Krautzberger | 407/49 |
| 4,907,631 | 3/1990 | Krautzberger | 407/49 |
| 5,076,334 | 12/1991 | Landtwing | 407/108 |
| 5,333,659 | 8/1994 | Carpenter et al. . | |
| 5,456,300 | 10/1995 | Rosenkranz et al. | 144/230 |

FOREIGN PATENT DOCUMENTS

| | | |
|---|---|---|
| 2 200 089 | 4/1974 | France . |
| 2 306 053 | 10/1976 | France . |
| 2 477 460 | 9/1981 | France . |
| 6 933 019 | 12/1969 | Germany . |
| 2 208 687 | 6/1973 | Germany . |
| 679755 A5 | 4/1992 | Germany . |

*Primary Examiner*—W. Donald Bray
*Attorney, Agent, or Firm*—Blank Rome Comisky & McCauley LLP

[57] ABSTRACT

The invention concerns a cutter head, in particular a planing cutter head, whose blade carrier (1) has at least one mounting (5), facing radially outwards, for a blade (7). Fitted in each mounting (5) is a wedge grip (17) which can be moved relative to the blade carrier (1) and which presses the blade (7) against a stop (9) on the mounting (5) when moved with at least a component of motion radially outwards. Located between the blade (7) and the wedge grip (17) is a mounting strip (21) which can be moved relative to the wedge grip (17) and the stop (9) on the mounting (5) and which releases the blade (7) for removal radially outwards when the wedge grip (17) is displaced inwards.

8 Claims, 3 Drawing Sheets

CUTTER HEAD, IN PARTICULAR A PLANING CUTTER HEAD

BACKGROUND OF THE INVENTION

The invention relates to a cutter head, in particular a planing cutter head, having the features of the precharacterizing clause of claim 1.

SUMMARY OF THE INVENTION

A known cutter head of the said type, for the working of wood, has a blade carrier, which is provided with a plurality of mountings for blades at equal intervals along its circumference. The mountings are open radially outwards and extend parallel to the axis of rotation of the blade carrier. Provided in each mounting is a wedge grip which can be moved relative to the blade carrier and with respect to the respective blade. When the cutter head is set in rotation, the wedge grips move radially outwards on account of the centrifugal force. The wedge grips are designed such that, during this movement, they press the blades against a stop of the mounting. When the cutter head is at rest, the blades can be removed in the axial direction, for example for resharpening. In spite of the simple clamping mechanism, the cutter head described still leaves something to be desired in use.

BRIEF DESCRIPTION OF THE INVENTION

The invention is therefore based on the object of improving a cutter head of the type described at the beginning. This object is achieved according to the invention by a cutter head as set both herein.

By virtue of the fact that, in the case of the cutter head according to the invention, between the blade and the wedge grip there is arranged a holding strip which can be moved relative to the wedge grip and the stop and which releases the blade for removal radially outwards when the wedge grip is moved inwards, the blades can be removed from the cutter head for turning or resharpening without disassembling the said cutter head, even if the end faces of the latter are not accessible or not adequately accessible.

For a defined position of the blade and the holding strip during clamping and for absorbing the centrifugal forces, it is of advantage to provide positioning elements between the blade and the holding strip.

An advantageous combination of the swivelling function and the absorption of centrifugal forces is obtained if the holding strip grips underneath the stop in the radial direction, forming an at least linear location of contact. The swivelling movement is assisted if between the holding strip and the wedge grip there is provided at least one compression spring, the bearing point of which on the holding strip lies radially further inwards than the location of contact between the holding strip and the stop. If the location of contact forms a plane running parallel to the free face of the blade, this provides the advantage that the cutting circle remains constant when the blade is resharpened.

For movement of the wedge grip in the radial direction, both inwards and outwards, in particular for pretensioning, it is advantageous to provide one or more, depending on the length of the wedge grip, tensioning screws, which take the wedge grip along with them in both directions.

To adapt the chip breaking and chip flow to different workpiece materials, it is of advantage if the stop is designed as an exchangeable stop strip, in order to be able to vary the size of the cutting face, located radially outside the stop strip, of the blade and/or the chip space.

In order to define the maximum amount of material that can be removed at the front of the blade in the case of resharpenable blades, the blade advantageously has in its front a groove, the depth of which is chosen to be equal to maximum amount of material that can be removed.

To reduce weight, in particular in the case of long cutter heads, it is of advantage to produce the blade carrier from aluminium.

DETAILED DESCRIPTION OF THE PREFERRED EMBODIMENTS

Figure 1:
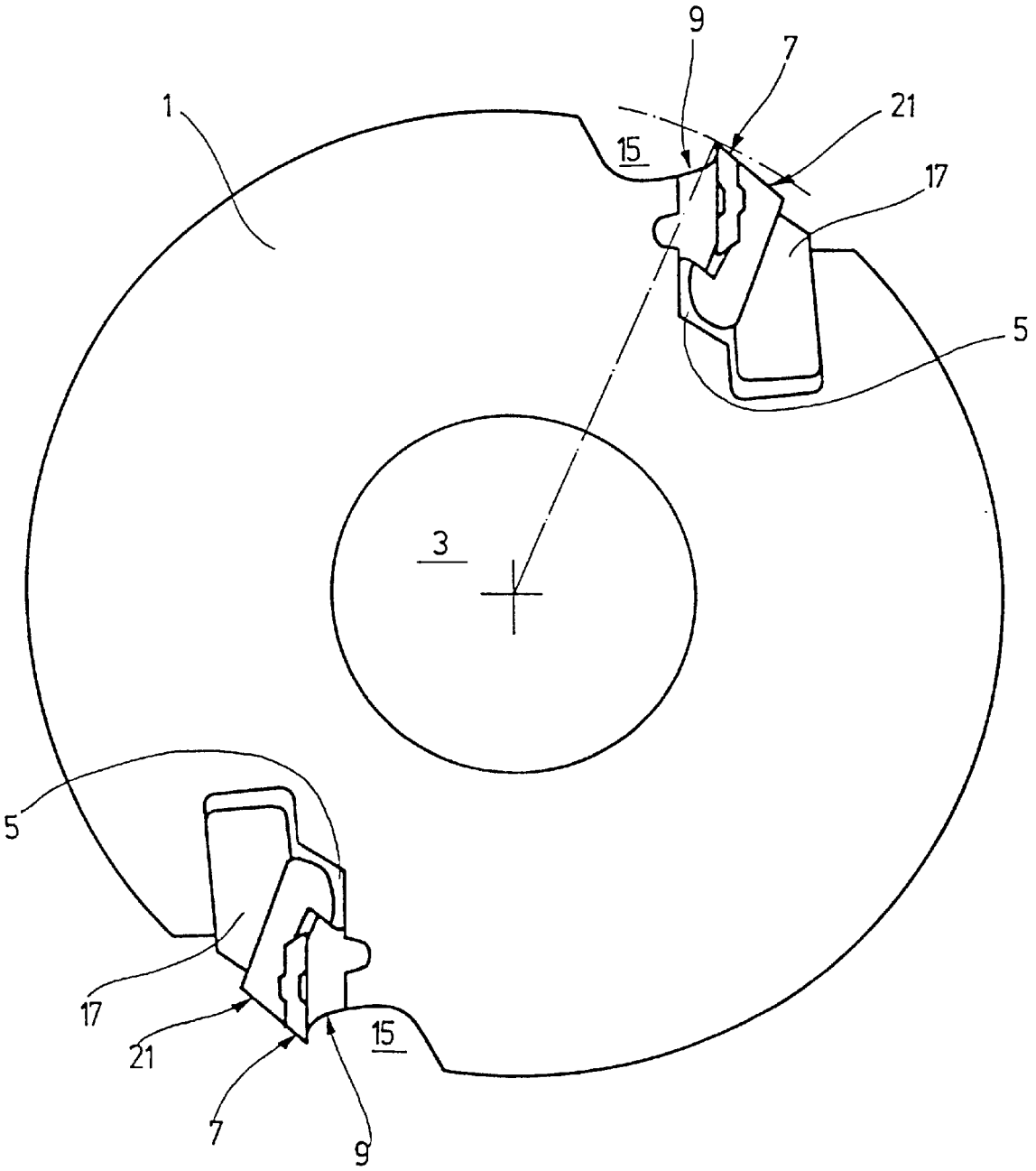
Figure 2:
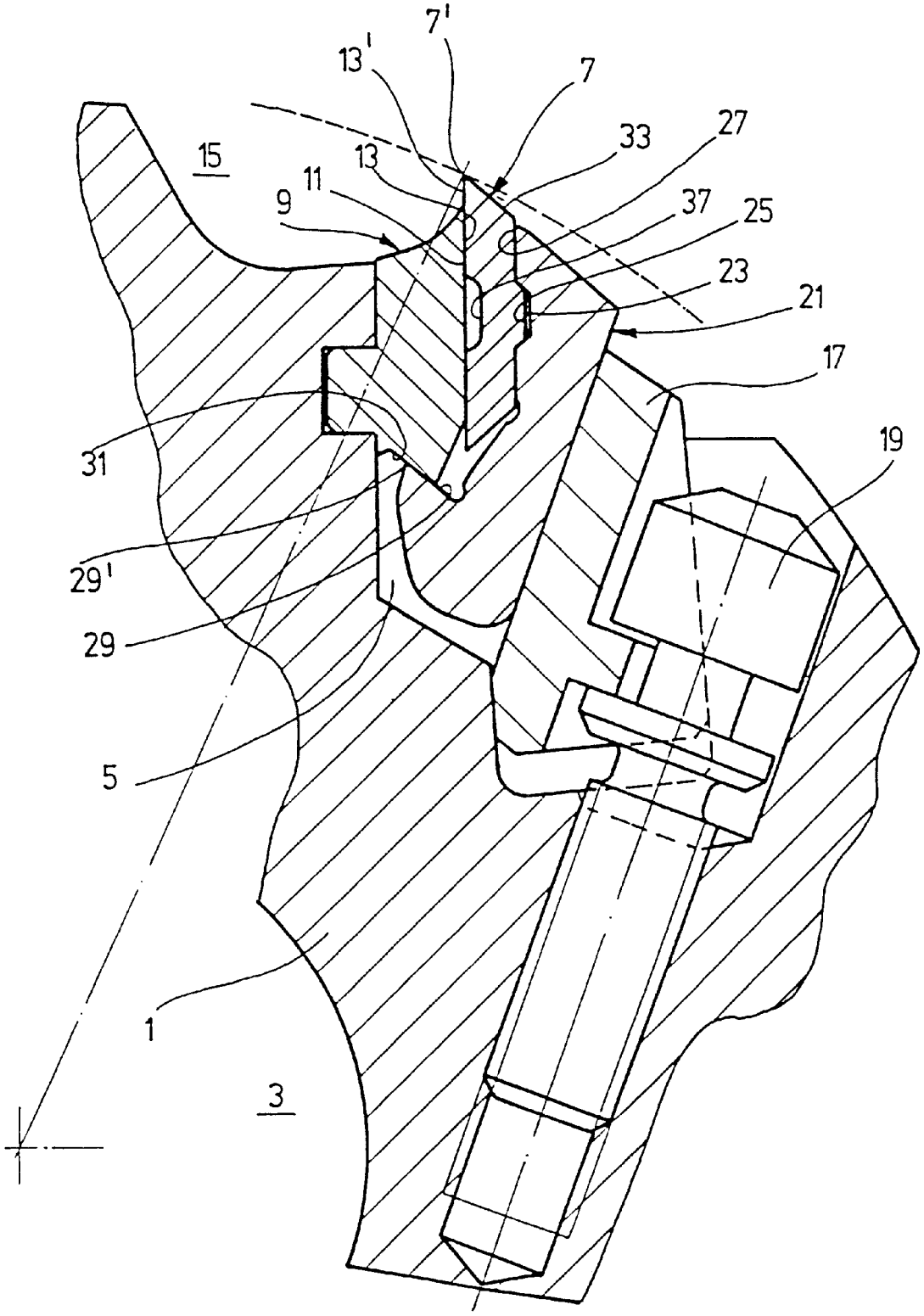
Figure 3:
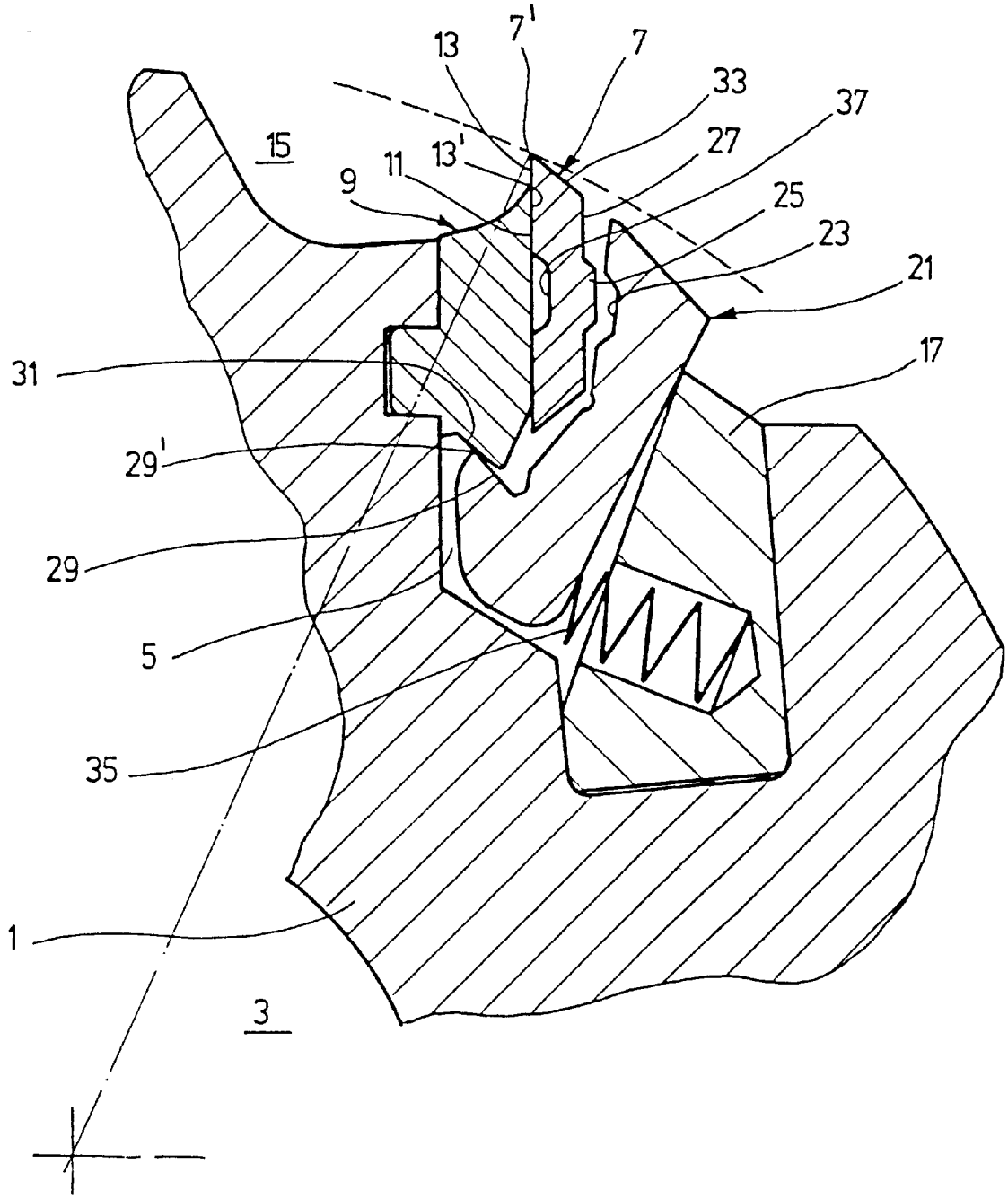

The invention is explained in more detail below with reference to an exemplary embodiment represented in the drawing, in which:

FIG. 1 shows a front view of the exemplary embodiment in the pretensioned state, FIG. 2 shows an only partially represented section through the exemplary embodiment in the pretensioned state, in the plane of a tensioning screw, FIG. 3 shows an only partially represented section of the exemplary embodiment in the released state, in the plane of a compression spring.

A planing cutter head for working wood or plastic has a blade carrier 1, which is produced from a cylinder and is provided with a central through-bore 3 for receiving a shaft. The centre of the through-bore 3 defines the axis of rotation of the blade carrier 1. To reduce the weight, the blade carrier 1 is preferably produced from aluminium. The blade carrier 1 has along its outer lateral surface two mutually opposite mountings 5 of a groove-like form, which are open radially outwards and extend parallel to the axis of rotation of the blade carrier 1. The planing cutter head according to the invention may also have a different number of mountings, the mountings being provided at equal intervals in the circumferential direction in order to avoid imbalances.

Each mounting 5 provided respectively contains a device for clamping in a blade 7. On the flank of the mounting 5 which is leading in the direction of rotation there is provided a stop strip 9 which, by means of a strip-shaped projection, which preferably extends over the entire length of the stop strip 9, engages in a corresponding, groove-like depression in the blade carrier 1 and is connected securely but releasably to the latter by screws which are not shown in the drawing. In a simplified embodiment of the cutter head according to the invention, the stop strip 9 may also be formed in one piece with the blade carrier 1. The stop strip 9 serves on the one hand as a stop of the clamping device for the blade 7. For this purpose, the stop strip 9 has a planar stop face, 11, against which the blade 7 can bear with its front 13. At the same time, the stop strip 9, with its radially outer end, is part of the limitation of the chip space 15, which is formed ahead of the mounting 5 in the direction of rotation as a recess in the outer lateral surface of the blade carrier 1. The part of the front 13 which protrudes beyond the stop strip 9 forms the cutting face 13' of the blade 7. The cutting edge 7' of the blade is formed by that end of the cutting face 13' at the greatest distance from the axis of rotation of the blade carrier 1, which distance thus at the same time defines the radius of the cutting circle. The chip breaking takes place at the transition between the cutting face 13' and the stop strip 9. The chip flow takes place into the chip space 15. Different, exchangeable stop strips 9 allow both the size of the cutting face 13' and the shape and/or surface condition of the chip space 15 to be changed. In this way, the chip breakers and the chip flow can be adapted to the different workpiece materials to be worked.

On the flank of each mounting 5 which is trailing in the direction of rotation there bears as a further part of the clamping device a wedge grip 17, which can be moved along this flank with at least one component of motion in the radial direction. The wedge grip 17 has the form of a wedge which points with its tapering end outwards from the mounting 5. For movement of the wedge grip 17 along the flank of the mounting 5, at least one tensioning screw 19 is provided, which is in engagement with the wedge grip 17 such that the wedge grip 17 can be moved with play by means of this tensioning screw 19, both inwards and outwards. For this purpose, the tensioning screw 19 has in its head an annular groove, into which a projection of the wedge grip 17 engages with a small amount of play. In the pretensioned state of the clamping device for the blade 7, which is described below, the wedge grip 17 is in a radially outer position.

Arranged between the blade 7 and the wedge grip 17 as a blade holder and further part of the clamping device is a holding strip 21. In the pretensioned state, the holding strip 21 bears on its trailing side in the direction of rotation flat against the wedge grip 17. For positioning the blade 7, the holding strip 21 has on its leading side in the direction of rotation a positioning groove 23, into which the blade 7 engages with a positioning projection 25. Otherwise, the holding strip 21 bears flat against the back 27 of the blade 7. The assignment of the two positioning elements 23 and 25 with respect to the blade 7 and with respect to the holding strip 21 could also be exactly reversed. Apart from being intended for positioning the blade 7, the positioning groove 23 and the positioning projection 25 are designed for absorbing part of the centrifugal forces of the blade 7 when the cutter head is rotating. They are therefore shaped such that, in the pretensioned state, the blade 7 bears radially outwards against the holding strip 21 and is immovable in relation to it, in other words is held in a defined position.

At its radially inward end, the holding strip 21 is shaped such that it engages under the stop strip 9 in the radial direction. In this case, in the pretensioned state, the holding strip 21 bears with a radially outwardly directed positioning face 29 flat against a radially inwardly directed bearing face 31 of the stop strip 9. As a result, the holding strip 21 at the same time holds the blade 7 in a defined position with respect to the stop strip 9. The location of contact between the positioning face 29 and the stop face 21 is a plane which runs parallel to the free face 33 of the blade 7.

When the rotation of the cutter head begins, the wedge grip 17 moves radially outwards, which allows the play between the tensioning screw 19 and the wedge grip 17. The centrifugal forces acting on the wedge grip 17 are deflected by its wedge shape initially onto the holding strip 21 and then onto the blade 7, whereby the blade 7 is pressed against the stop strip 9, so as to be clamped. At the same time, the centrifugal forces of the holding strip 21 and consequently also of the blade 7 are transferred via the said location of contact to the stop strip 9. In comparison with the pretensioned state, with the exception of the wedge grip 17, the position of the other parts of the clamping device with respect to one another and with respect to the blade 7 does not change in this clamped state. Part of the centrifugal forces of the blade 7 and of the holding strip 21 is absorbed by the friction between these parts and between the blade 7 and the stop strip 9. The relevant normal force for this friction is the tension of the clamping device, in particular of the wedge grip 17.

By actuating the tensioning screw 19, the clamping device for the blade 7 can be transferred from the pretensioned state into the released state, which is described below. In this case, the tensioning screw 19 initially takes the wedge grip 17 radially inwards with it. Between the wedge grip 17 and the holding strip 21, one or more compression springs 35 are provided. Each compression spring 35 is supported in a blind hole of the wedge grip 17 and comes to bear with one end against the holding strip 21. This bearing point in this case lies radially further inwards than the location of contact between the holding strip 21 and the stop strip 9, formed by the positioning face 29 and the bearing face 31. The movement of the wedge grip 17 inwards causes the compression spring 35 to act in such a way that it exerts a torque on the holding strip 21. The holding strip 21 in this case swivels about an edge 29' on the fringe of the positioning face 29. The edge 29' is that part of the holding strip 21 which engages furthest underneath the stop strip 9. On account of the position of the bearing point of the compression spring 35, the swivelling movement of the holding strip 21 is directed such that the holding strip 21 moves away from the blade 7 towards the wedge grip 17. During this swivelling movement, the positioning face 29 moves away from the bearing face 31, but the edge 29' remains in linear contact with the bearing face 31. The dimensions, angles, paths of movement and swivelling ranges of the positioning groove 23, the positioning projection 25, the wedge grip 17 and the holding strip 21 are chosen such that the holding strip 21 can swivel into a position in which it releases the blade 7, and the latter can be removed radially outwards.

The removed blade 7 can be turned and refitted, provided that the blade 7 is designed symmetrically with respect to a longitudinal plane. The blade 7 therefore preferably has an approximately trapezoidal cross-section. Furthermore, the removed blade 7 can be resharpened, being ground away at its front 13. As a means of indicating the maximum depth to which it can be ground away, the blade 7 has on its front 13 a groove 37, the base of which defines that plane up to which the front 13 may be ground away. The parallelism between the free face 33, the bearing face 31 and the positioning face 29 in the clamped state and the pretensioned state ensures that, even after grinding away the front 13, because of the displacement of the holding strip 21 parallel to the free face 33 during clamping, the distance between the new cutting edge 7' and the axis of rotation of the blade carrier 1, in other words the new radius of the cutting circle, coincides with the old radius.

The blade 7, the stop strip 9, the wedge grip 17 and the holding strip 21 extend exactly like the mounting 5 parallel to the axis of rotation of the blade carrier 1, preferably over its entire length. A suitable way for producing these parts is to use profiled bars and to saw them to the correct length. Although certain presently preferred embodiments of the present invention have been specifically described herein, it will be apparent to those skilled in the art to which the invention pertains that variations and modifications of the various embodiments shown and described herein may be made without departing from the spirit and scope of the invention. Accordingly, it is intended that the invention be limited only to the extent required by the appended claims and the applicable rules of law.

What is claimed:

1. Cutter head comprising:

a blade carrier having at least one radially outwardly open mounting for a blade;

a stop disposed in the mounting;

a wedge grip, disposed in the mounting, which is moveable relative to the blade carrier and presses the blade against the stop during movement of the blade carrier;

a moveable holding strip between the blade and the wedge grip, which releases the blade when the wedge grip is moved inwards to allow removal of the blade radially outwardly, the holding strip extending radially inwardly of the stop to contact a radially inner portion of the stop at a contact point; and a compression spring positioned between the holding strip and the wedge grip which bears against the holding strip at a bearing point which is radially inward from the contact point between the holding strip and the stop.

2. Cutter head according to claim 1, further including positioning elements between the blade and the holding strip which keep the blade and the holding strip in a defined position with respect to each other during clamping.

3. Cutter head according to claim 2, wherein the blade has a free face, and wherein the contact point between the holding strip and the stop when the blade is clamped forms a plane which runs parallel to the free face of the blade.

4. Cutter head according to claim 3, further including at least one tensioning screw for moving the wedge grip radially, both inwards and outwards.

5. Cutter head according to claim 4, wherein the stop is designed as an exchangeable stop strip.

6. Cutter head according to claim 5, wherein:

the blade extends beyond the stop strip to define a cutting face;

the blade carrier has a chip space adjacent to the mounting; and the cutter head further comprises an additional stop strip for being exchanged with the exchangeable stop strip to change at least one of a size of the cutting face, a shape of the chip space and a surface condition of the chip space.

7. Cutter head according to claim 6, wherein the blade has a groove in its front.

8. Cutter head according to claim 7, wherein the blade carrier is made of aluminum.

* * * * *